United States Patent [19]

Kondo et al.

[11] Patent Number: 4,837,200

[45] Date of Patent: Jun. 6, 1989

[54] IMAGE-RECEIVING SHEET FOR THERMAL TRANSFER PRINTING

[75] Inventors: Hiromasa Kondo, Ikoma; Yoshitaka Okumura, Kyoto; Terunobu Fukui, Nishinomiya; Noritaka Egashira, Ichikawa; Tamami Iwata, Tokyo; Naoto Satake, Tokyo, all of Japan

[73] Assignees: Kanzaki Paper Manufacturing Co., Ltd.; Dai Nippon Insatsu Kabushiki Kaisha, both of Tokyo, Japan

[21] Appl. No.: 222,168

[22] Filed: Jul. 21, 1988

[30] Foreign Application Priority Data

Jul. 24, 1987 [JP] Japan ..... 62-186095
Jul. 24, 1987 [JP] Japan ..... 62-186096
Oct. 15, 1987 [JP] Japan ..... 62-259968

[51] Int. Cl.[4] ..... B41M 5/035; B41M 5/26

[52] U.S. Cl. ..... 503/227; 8/471; 428/195; 428/327; 428/483; 428/913; 428/914

[58] Field of Search ..... 8/471; 428/195, 327, 428/483, 913, 914; 503/227

[56] References Cited

U.S. PATENT DOCUMENTS 4,720,480 1/1988 Ito et al. ..... 503/227

FOREIGN PATENT DOCUMENTS 1144394 7/1986 Japan ..... 503/227

*Primary Examiner*—Bruce H. Hess
*Attorney, Agent, or Firm*—Wenderoth, Lind & Ponack

[57] ABSTRACT

An image-receiving sheet for thermal transfer printing comprising on a substrate an intermediate layer made primarily of a resin insoluble in organic solvents, and an image-receiving layer made primarily of a resin soluble in organic solvents and formed on the intermediate layer. This type of sheet is significantly improved in smoothness and blocking properties, enabling one to obtain print images of a very high quality, by thermal transfer printing, which are substantially free from the known problem relating to a missing transfer portion and which are high in the optical density for images as printed.

13 Claims, 1 Drawing Sheet

IMAGE-RECEIVING SHEET FOR THERMAL TRANSFER PRINTING

BACKGROUND OF THE INVENTION

1. Field of the Invention

This invention relates to an improvement in image-receiving sheets for thermal transfer printing which ar adapted for printing images thereon by transfer of a sublimable dye of a thermal transfer sheet by application of heat from a thermal head in accordance with image signals.

2. Description of the Prior Art

Thermal printing systems in which printed images are obtained upon reception of input signals are made up of a relatively simple apparatus and are inexpensive and low in noises, so that they have increasing utility in various fields such as facsimiles, terminal printers for electronic computers, printers for measuring instruments, video printers, and the like.

A recording medium generally used in these thermal printing systems is a so-called color-developing, heat-sensitive recording paper having a recording layer which undergoes a physical or chemical change by application of heat to form a color. However, the recording paper of the color developing type has disadvantages in that it is liable to undesirably develop the color during the process of fabrication or during storage. In addition, the image printed on the paper is poor in storage stability and is apt to fade on contact with organic solvents or chemicals. To avoid this, there has been proposed a thermal transfer printing system in which a recording medium utilizing a dye or colorant is used instead of the color-developing thermosensitive recording paper.

In this thermal transfer printing system, a colorant or colored dye is caused to melt, evaporate or sublimate by application of heat and transferred on a recording paper, thereby forming a record image by adhesion, adsorption or reception of the dye on the recording paper. For instance, there has been proposed a mechanism as is shown in FIG. 2. In the mechanism, a thermal transfer sheet 201 having a dye layer on a substrate and a thermal transfer image-receiving sheet 203 set on a platen roller 202 are superposed and heated from the non-faced side of the thermal transfer sheet 201 by a heating means 204 such as a thermal head. The thermal head 204 is controlled with electric signals corresponding to image information. As a result, the dye of the thermal transfer sheet is transferred on an image-receiving layer.

For full color printing, a thermal transfer sheet used is a sheet which has been coated or printed, as shown in FIG. 3, a start mark 301 and dyes including yellow 302, magenta 303 and cyan 304, and also including a black dye, if necessary. This sheet is superposed on a thermal transfer image-receiving sheet and the yellow, magenta and cyan dyes are successively heated according to the respective color-separated image signals to make an image in which the three colors are superposed. Thus, a natural color, photographic image is formed.

A known thermal transfer image-receiving sheet used in this type of printing system is one which has an image-receiving layer obtained by coating onto a paper substrate such as high-quality paper a coating of a dispersion of finely powdered silica or calcium carbonate in a binder such as a thermoplastic polyester resin.

However, when the image-receiving layer is formed on the substrate, such as wood free paper, whose smoothness is low, it is difficult to obtain a satisfactory printed image. Especially, where an image with a degree of gradation is transferred, missing transfer portions are liable to occur at half-tone to low-tone portions. Although images such as of symbols, letters and figures are substantially solid and thus the missing transfer portions are not conspicuous, missing transfer portions on photographs or colored solid images will undesirably tend to become marked and produce vital deficiencies. Accordingly, there is a strong demand for eliminating such deficiencies.

In reply to said demand, various improvements have been proposed including, for example, (1) a method proposed in Japanese Laid-open Patent Application No. 61-172795 in which an intermediate layer is formed beneath an image-receiving layer to improve a smoothness on the surface of the image-receiving layer, and (2) a method proposed in U.S. Pat. No. 4,720,480 in which an intermediate layer made primarily of a flexible resin is formed.

However, these improvements are still accompanied with other problems and thus, satisfactory results cannot always be obtained. For instance, the method (1) has a problem that the productivity lowers because it comprises the step in which the intermediate layer which has been kept as softened or plastic is brought into close contact with mirror-like finished chromium plated metal drum for heating and drying. The method (2) involves the problem that a soft resin such as MBR, polyurethane, polybutadiene, SBR or the like, which has been formulated so as to improve the adhesiveness, is liable to block when wound up after coating and drying. Additionally, the resin dissolves in an organic solvent of the coating solution forming an image-receiving layer, so that the image-receiving layer cannot be formed uniformly, thus causing a lowering of an optical density of the printed image.

SUMMARY OF THE INVENTION

An object of the invention is to provide an improved image-receiving sheet for thermal transfer printing which is free from the foregoing problems which are found on the known image-receiving sheet and which enables one to form beautiful printing images of high optical density without involving the known problem relating to a missing transfer portion.

Another object of the invention is to provide an improved image-receiving sheet capable of forming images of high quality having good gradation and which is free from the known problem relating to a missing transfer portion even upon using as a base sheet various paper sheets made primarily of pulp fibers.

The present inventors have made intensive studies in order to achieve the above objects and, as a result, found that when a base sheet is first formed with an intermediate layer made primarily of a resin insoluble in organic solvents and then with an image-receiving layer made chiefly of a resin soluble in organic solvents, the smoothness and the anti-blocking properties are significantly improved. And this results in making printed images beautiful without causing any missing transfer portion and making the printed images to have an excellent optical density.

The present invention has been accomplished based on the above findings.

DETAILED DESCRIPTION OF THE INVENTION

The present invention contemplates to provide an image-receiving sheet for thermal transfer printing which is characterized by comprising a substrate, an intermediate layer formed on the substrate and containing a resin insoluble in organic solvent, and an image-receiving layer formed on the intermediate layer and containing as a primary component a resin soluble in organic solvent.

Figure 1:
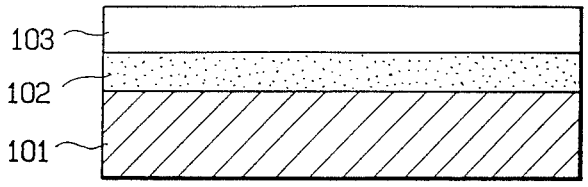
FIG. 1 is a schematic sectional view of an image-receiving sheet for thermal transfer printing according to the present invention, in which 101 indicates a base sheet or substrate, 102 indicates an intermediate layer, and 103 indicates an image-receiving layer.
Figure 2:
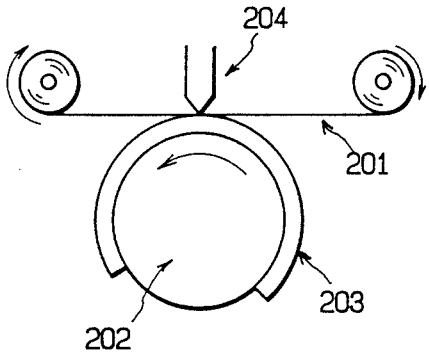
FIG. 2 is a schematic view showing a printing system of the thermal transfer type, in which indicated by 201 is a thermal transfer sheet, by 202 is a platen roller, by 203 is a sheet of receiving an image by thermal transfer, and by 204 is a thermal printing head.
Figure 3:
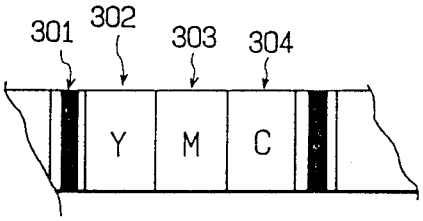
FIG. 3 is a schematic view of a full-color thermal transfer sheet, in which indicated by 301 is a start mark, by 302 is a yellow color, by 303 is a magenta color, and by 304 is a cyan color.

FIG. 1 is a schematic sectional view showing an image-receiving sheet for thermal transfer printing according to the invention. In the figure, 101 denotes a substrate, 102 denotes an intermediate layer, and 103 denotes an image-receiving layer.

These elements of the image-receiving sheet according to the invention will be below described in more detail.

Intermediate Layer 102

First, the characteristic properties of the intermediate layer which is one of prominent features of the invention are described in detail.

The intermediate layer of the image-receiving sheet of the invention contains as its primary component resins which are insoluble in organic solvents. It has been found that when a copolymer latex having a specific type of monomer composition and a certain gel content (content of toluene-insoluble component) is used as the organic solvent-insoluble resin, the organic solvent resistance and blocking properties of the intermediate layer are effectively improved without impeding the smoothness of the image-receiving layer. This results in efficient production of an image-receiving sheet capable of yielding printing images which are free from missing transfer portions, high in optical density and beautiful.

The monomer composition and gel content of the copolymer latex are shown below.

Monomer Composition (A) Aliphatic conjugated diolefinic monomer 20–70 wt. %

(B) Unsaturated acid monomer 0.5–15 wt. %

(C) Other olefinic monomer 15–79.5 wt. %

Gel Content: 85–100 wt. %

The aliphatic conjugated diolefinic monomer (A) is generally selected from those having from 4 to 10 carbon atoms. Specific examples include 1,3-butadiene, 2-methyl-1,3-butadiene, 2,3-dimethyl-1,3-butadiene, halogen-substituted butadienes, substituted linear conjugated pentadienes, linear or branched conjugated hexadienes, and the like. The aliphatic conjugated diolefinic monomer should be contained in an amount of from 20 to 70 wt. % of the copolymer latex. When the content is less than 20 wt. %, the resultant resin becomes hard and brittle and exhibits poor film forming properties and adhesion strength. Over 70 wt. %, the resultant resin becomes too soft even when the gel content is over 85 wt. %, tending to cause sticking on rolls during the course of coating or blocking.

The unsaturated acid monomer (B) includes, for example, acrylic acid, methacrylic acid, maleic acid, fumaric acid, itaconic acid, dicarboxylic acid anhydrides, dicarboxylic acid monoalkyl esters, and the like. The unsaturated acid monomer is contained in an amount of from 0.5 to 15 wt. % of the copolymer latex. If the content is less than 0.5 wt. %, the mechanical stability of the copolymer latex lowers, whereas over 15 wt. %, the latex tends to undesirably become too viscous.

The olefinic monomer (C) other than the aliphatic conjugated diolefinic monomer (A) and the unsaturated acid monomer (B) includes, for example, aromatic vinyl monomers such as styrene, alpha-methylstyrene, dimethylstyrene vinyl toluene and the like, acrylates monomers such as methyl acrylate, ethyl acrylate, butyl acrylate, 2-ethylhexyl acrylate, lauryl acrylate, 2-hydroxyethyl acrylate, 2-hydroxypropyl acrylate and the like, methacrylate monomers such as methyl methacrylate, ethyl methacrylate, 2-hydroxyethyl methacrylate, 2-hydroxypropyl methacrylate and the like, unsaturated nitrile monomers such as acrylonitrile, methacrylonitrile and the like, and acrylamide, N-methylolacrylamide, glycidyl acrylate, glycidyl methacrylate and the like.

The gel content of the copolymer latex, which is one of important features of the invention, should be controlled in a range of from 85 to 100 wt. %. Although the gel content may be influenced depending upon the monomer composition, the yield of emulsion polymerization, the polymerization temperature and the like, it should be controlled over 85 wt. % by controlling an amount of a chain transfer agent such as carbon tetrachloride, dodecyl mercaptan, octyl mercaptan or the like or by appropriately using a crosslinking agent such as methylenebisacrylamide, divinylbenzene, diallyl phthalate or the like. When the gel content is less than 85 wt. %, there may be the fear that blocking will occur, making it impossible to wind up a final product after coating.

It will be noted that the gel content used herein is a value determined according to the following procedure. A latex is allowed to stand on a glass plate at room temperature (in a air-dried condition) over 24 hours, after which it is dried in vacuum for 2 to 3 hours to obtain an about 1 mm thick latex film. About 0.5 g of the thus obtained film is accurately weighed and immersed in 50 ml of toluene at room temperature for 24 hours. Subsequently, the toluene solution is passed through a 200 mesh stainless steel screen to collect an insoluble matter, followed by drying it at 135° C for 3 hours and measuring the weight. Then, the ratio (wt. %) to the weight prior to the immersion in the toluene solution is calculated as the gel content.

In the practice of the invention, the above specific type of copolymer latex should preferably be contained in the intermediate layer in an amount of not less than 60 wt. %, more preferably not less than 70 wt. %, of the total solid of the intermediate layer in order to obtain a desired high optical density for images as printed.

The intermediate layer may further contain various additives including pigments such as silica, alumina, clay, calcium carbonate and plastic pigments, lubricants, fluorescent dyes, and other adhesives in amounts not impeding the effects of a resin insoluble in organic solvents.

When large amounts of fine particles of inorganic pigments are added to the intermediate layer, the heat insulating properties and cushioning properties of the intermediate layer lower, causing the optical density to lower with an increasing number of missing transfer portions. To avoid this, it is considered to use a large amount of fine particles of organic pigments which have higher heat insulating properties than the inorganic pigments. However, because the image-receiving layer is generally formed using organic solvents, such organic pigments should have a high resistance to organic solvent.

Solvent-resistant organic pigment fine particles include, for example, those of polyolefin resins, phenolic resins, urea resins, melamine resins, allyl resins, epoxy resins, polyimide resins, benzoguanamide resins, and the like. However, the resins other than the polyolefin resins are all thermosetting resins and thus lower the cushioning properties of the intermediate layer. Accordingly, studies have been made on fine particles of various polyolefin resins. As a result, it has been found that certain types of polyolefin resin fine particles can significantly improve the anti-blocking properties and eliminate the known problems relating to occurrence of missing transfer portions but they lower the optical density for images as printed. Further studies have a revealed that the above results are greatly influenced by thermal properties of the fine particles of polyolefin resins. That is, it has been found that when fine particles of polyolefin resins having certain ranges of a melting point and a heat absorption are used even in combination with ordinary latices as an adhesive, good anti-blocking properties are obtained with good smoothness of an image-receiving layer. This results in formation of a image-receiving sheet which is free from the problem relating to missing transfer portion and which is high in the optical density for images as printed.

The fine particles of a certain type of polyolefin resin should preferably have a melting point not lower than 70° C., more preferably not lower than 100° C., and a heat absorption, accompanied by softening and phase transfer at the time of heating, of not larger than 50 cal/g. If the melting point is lower than 70° C., he fine particles melt during drying a coating for the intermediate layer, so that they bond together by fusion or impregnate into a substrate. Thus, the resultant intermediate layer lowers in smoothness. When the heat absorption exceeds 50 cal/g, heat from a thermal head is consumed in the form of latent heat, leading to a lowering of the transfer density.

The fine particles of the polyolefin resins includes those of polyethylene, polypropylene, polybutene-1, polyisobutene, polypentene-1, polyhexene-1, poly-3-methylbutene-1, poly-methylpentene-1, poly-5-methylhexene-1, and copolymers of these olefins. For the production of the image-receiving sheet for thermal transfer printing according to the invention, fine particles of the above polyolefin resin having defined ranges of a melting point and an heat absorption are used with an organic solvent-insoluble resin in the intermediate layer. Preferably, polyethylene, polypropylene and copolymers of ethylene and propylene are used as the polyolefin resin in the form of fine particles.

It should be noted that the melting point used herein means a temperature at which an endothermic peak appears when measured by differential thermal analysis. The heat absorption accompanied by softening or phase transfer means an absorption of heat in the vicinity of the melting point measured by the differential thermal analysis.

When the size of the fine particles of polyolefin resins is smaller than 0.1 micrometer, satisfactorily high smoothness cannot be obtained. Over 20 micrometers, the smoothness also lowers. In view of this, the particle size is preferably in the range from 0.1 to 20 micrometers.

Desired effects are obtained when the fine particles are contained in an amount of not less than 10 wt. %, preferably from 60 to 90 wt. %, as the total solid content in the intermediate layer.

If the content is less than 10 wt. %, satisfactory effects of reducing the blocking tendency and improving the smoothness cannot be expected. Over 90 wt. %, the strength of the intermediate layer lowers, with the fear that the intermediate layer may separate from a substrate during printing or a coating for the image-receiving layer may impregnate in the intermediate layer or the substrate when coated, disenabling a satisfactory image-receiving layer to be formed.

As a binder for the fine particles of polyolefin resins, such a specific type of copolymer latex as set forth before can be used with very good results. However, where the fine particles are used in amounts of not less than 60 wt. % in the intermediate layer, resins ordinarily used as a binder or adhesive, e.g. SBR, polyurethane, polybutadiene, MBR, vinyl acetate-ethylene copolymers, may be used as they are.

The present inventors have intensively made further studies on the organic solvent-resistant resins. As a result, it has been found that when hollow particles are contained in the resin, the heat-insulating properties of the intermediate layer can be remarkably improved together with an attendant remarkable improvement in the optical density for images as printed.

The hollow particles useful for this purpose are, for example, those described below.

(1) Thermally expandable plastic materials

Hollow particles with capsule walls made of thermoplastic materials such as vinylidene chloride-acrylonitrile copolymers and a volatile expanding agent, such as propane, n-butane, iso-butane or the like, in the inside of individual particles.

Commercially available products: Matsumoto Microsphere F-30, made by Matsumoto Yushi-Seiyaku Co., Ltd.; and Expancel 551, 642, made by KemaNobel Company (2) Hollow polymers of a microcapsular form Hard resins such as acryl-styrene copolymers are used as a shell in which water is contained and is flown away upon drying to form hollow polymer particles.

Commercially available product: Ropaque OP-84J, made by Rohm & Haas Japan Kabushiki Kaisha.

The above hollow particles have generally a size of from 0.1 to 200 micrometers. Preferably, those hollow particles having a size of from 0.1 to 20 micrometers are used.

When the size is less than 0.1 micrometer, satisfactory heat-insulating effects cannot be expected. Over 20 micrometers, the smoothness of the image-receiving layer lowers. In this connection, however, the hollow particles obtained by thermal expansion of thermally expandable plastic materials have the cushioning action and are flexible, so that they are usable when the size is not larger than 100 micrometers.

The above-mentioned hollow particles are all soluble in organic solvents such as methyl ethyl ketone and should be used after dispersion in an organic solvent-resistant resin used as an binder. Alternatively, the intermediate layer may be formed of a layer of the hollow particles and a protective layer of an organic solvent-resistant resin formed on the hollow particle layer.

Preferable organic solvent-resistant resins are copolymer latices having specific monomer composition and gel content. Aside from the latices, resins having good film-forming properties and capable of inhibiting organic solvents from infiltrating may be used including, for example, hydrophilic polymers such as polyvinyl alcohol, casein, starch and the like, acrylic esters, ethylene-vinyl acetate copolymers carboxyl group-containing polyethylene, and the like. Of these, the copolymer latices and the hydrophilic polymers including polyvinyl alcohol, casein, starch and the like are preferred because of good synergistic effects with the hollow particles. The hollow particles are favorably used in an amount of not less than 50 wt. % of the total solids in the intermediate layer.

The thickness of the intermediate layer may be appropriately controlled depending upon the type of organic solvent-resistant resin and is generally in the range of from 10 to 50 micrometers, preferably from 15 to 30 micrometers. When the hollow particles made of a thermally expandable plastic material are used, dry coating of the intermediate layer is in the range of from 1 to 10 $g/m^2$, and preferably, from 2 to 6 $g/m^2$. For non-thermally expandable hollow particles, the thickness is in the range of from 5 to 50 micrometers, preferably from 10 to 30 micrometers.

The intermediate layer may further comprise microcapsules which contain a core substance having the plasticizing action on an image-receiving layer made primarily of a resin soluble in organic solvent, e.g. esters such as phosphoric esters, (tere)phthalic esters, adipic esters and the like, polyesters in the form of oligomers of dibasic acids and glycols or glycerine, epoxy fatty acid esters, and the like. The resultant thermal transfer image-receiving sheet is improved in the receptivity of sublimable dyes without involving any missing transfer portion and has a high optical density for images as printed. The wall of the capsule used above should permit thermal transmission of the core substance through the capsule wall when heated at the time of printing. For this purpose, the capsule wall is desired to be made of polyurethane or polyurea.

Substrate 101

As the substrate 101, there may be used, for example, a synthetic paper, a wood free paper, a No. 1 grade coated paper, a coated paper, a cast coated paper, polymer films, and composite sheets of these papers and films.

There are known a variety of paper sheets chiefly comprised of pulp fibers. It is commonly recognized that such paper sheet is considerably inferior to a synthetic film with respect to occurrence of missing transfer portions and the optical density for images as printed when employed as the substrate for an image-receiving sheet for thermal transfer printing and because of this, such paper sheet is not always considered to be usable as the substrate. However, in the present invention, there may be also used such paper sheet chiefly comprised of pulp fibers as the substrate 101. That is, even in the case where such paper sheet is used as the substrate 101, the image-receiving sheet to be prepared by forming a specific intermediate layer and a particular image-receiving layer thereon according to the present invention becomes to effectively attain the objects of the present invention.

Now, as a result of intensive studies by the present inventors on a paper sheet to be used as the substrate 101, it has been found that for formation of an intermediate layer having good cushioning and heat-insulating properties and high smoothness, not only the manner of formation of the intermediate layer, but also surface physical properties of the paper sheet substrate or support are very important factors. It has also been found that when the paper sheet substrate is appropriately defined with respect to the surface physical properties, an intermediate layer having desired characteristics can be very efficiently obtained.

More particularly when the physical properties of the paper sheet substrate on the surface contacting an intermediate layer meet the following requirements, the resultant intermediate layer are imparted with very good characteristics. This results in formation of an image-receiving sheet for thermal transfer printing which can exhibit a high degree of gradation and is substantially free from the known problems relating to occurrence of missing transfer portions when printed.

[Requirements for Surface Physical Properties of Paper Sheet]

(1) Smoothness not less than 6% when measured by means of a specular reflection smoothness tester under a pressure of 20 $kg/cm^2$.

(2) Water absorption: a 5 second value of 1 to 30 $g/m^2$ when determined according to Test Method for Water Absorption of Paper and Paperboard prescribed in JIS P-8140 (Cobb's method).

In general the smoothness of paper sheet is measured by means of a measuring instrument such as a specular reflection smoothness tester, a Bekk smoothness tester, a Parker Print Surf or the like. According to our detailed study, the measurement with an air leakage-type Bekk smoothness tester or Parker Print-Surf (H. E. Messmer Ltd.) is greatly influenced b air permeability of the substrate sheet. It has been found difficult to establish a correct interrelation between a measurement and an actual smoothness for various substrate sheets whose properties greatly differ from one another. Especially, when intimate contact with a thermal head or a thermal transfer sheet is an important factor as with an image-receiving sheet for thermal transfer printing, the measurement of smoothness under conditions where a sample is pressed against a glass surface at a given pressure as in the case of the specular reflection smoothness tester has been found to be most appropriate in view of the interrelation.

Thus, the smoothness of a paper substrate sheet used in the practice of the invention should be determined using a specular reflection smoothness tester. When a paper substrate sheet having not less than 6%, preferably not less than 7%, when measured at a pressure of 20 $kg/cm^2$ (a greater value leading to a better smoothness) is suitably used, an intermediate layer having desired characteristics can be very efficiently formed.

It takes only several seconds after application of a coating for the intermediate layer onto a substrate till drying the coating. If, however, a degree of sizing of the paper substrate sheet is too low, the coating solution for the intermediate layer infiltrates into the sheet during the coating, making it difficult to obtain a smooth intermediate layer. Accordingly, it is necessary that the substrate sheet have a suitable degree of sizing on the surface which contacts with the intermediate layer. This is the reason why a paper substrate sheet having a 5 second value of from 1 to 30 g/m$^2$, preferably from 3 to 20 g/m$^2$, when determined by the aforementioned Test Method for Water Absorption of Paper and Paperboard is selectively used.

When the water absorption is smaller than 1 g/m$^2$, the wetting between the paper substrate sheet and the coating solution for the intermediate layer becomes poor. Thus, difficulties will be involved in that the aqueous coating solution is repelled from the substrate or the adhesiveness of the resultant layer lowers. Over 30 g/m$^2$, the infiltration of the coating solution into the paper substrate sheet becomes excessive, disenabling one to obtain a smooth intermediate layer.

The paper-base substrates are not critical with respect to the type provided that the above requirements on the surface are satisfied. Examples of paper substrates include gloss, dull and mat-type coated papers such as No. 1 grade coated papers, coated papers, lightweight coated papers, finely coated papers, cast coated papers and the like, and non-coated papers such as wood free papers, medium papers, super calendered paper and the like.

Image-receiving Layer 103

Finally, the image-receiving layer is described. As described before, the image-receiving layer of the image-receiving sheet for thermal transfer printing according to the invention is formed primarily of resins soluble in organic solvents. Examples of the organic solvent-soluble resins are mentioned below.

(a) Resins having ester bonds: polyester resins, polyacrylate resins, polycarbonate resins, polyvinyl acetate resins, styrene-acrylate resins, vinyltoluenecarboxylate resins and the like.

(b) Resins having urethane bonds: polyurethane resins and the like.

(c) Resins having amide bonds: polyamide resins (nylons) and the like.

(d) Resins having urea bonds: urea resins and the like.

(e) Vinyl chloride-(meth)acrylic ester copolymers

The (meth)acylic acid monomers include: acrylic acid; acrylic acid salts such as calcium acrylate, zinc acrylate, magnesium acrylate, aluminium acrylate and the like; acrylates such as methyl acrylate, ethyl acrylate, butyl acrylate, 2-ethylhexyl acrylate, 2-ethoxyethyl acrylate, 2-hydroxyethyl acrylate, n-stearyl acrylate, tetrahydrofurfuryl acrylate, trimethylolpropane triacrylate and the like; methacrylic acid; and methacrylates such as methyl methacrylate, ethyl methacrylate, t-butyl methacrylate, tridecyl methacrylate, cyclohexyl methacrylate, triethylene glycol dimethacrylate, 1,3-butylene dimethacrylate, trimethylolpropane methacrylate and the like.

The ratio of vinyl chloride and the (meth)acrylic acid monomer for the copolymerization is preferably vinyl chloride/acrylic acid monomer =50 to 90%/50 to 10%. The molecular weight is generally in the range of from 5000 to 40000, preferably from 10000 to 30000.

Aside from the above copolymers, copolymers of monomers, such as acrylonitrile, vinylpyrrolidone, N-substituted maleimides, maleic acid and the like with vinyl chloride and a (meth)acrylic acid monomer are preferably used. In this case, the ratio of the other monomers is preferably from 0.1 to 30%.

As a matter of course, the copolymers may be used by blending with other resins.

(f) Other resins having bonds of high polarity: polycaprolactone resins, styrene/maleic acid resins, polyvinyl chloride resin, polyacrylonitrile resin and the like.

These resins have good receptivity of sublimable dyes and good storage properties and are thus favorably used in the practice of the invention. Of these, polyester resins and vinylchloride-(meth)acrylic ester copolymers are preferred because of their good transferability in dye stuffs and of their light fastness of transferred dye stuffs.

Apart from these resins, various additives may be added to the image-receiving layer, if necessary. Examples of such additives include mineral pigments such as, for example, titanium dioxide, zinc oxide, aluminium hydroxide, calcium carbonate, finely powdered silica and the like and organic white pigments such as plastic pigments in order to improve whiteness and thermal fusion properties, modified silicon resins, solid waxes, polyethylene waxes, amide waxes, calcium silicate, and the like. Moreover, for stabilizing printing images, UV absorbers and light stabilizers may be added in amounts not impeding the effects of the invention.

The coating for the image-receiving layer is applied onto a substrate in a dry thickness of from 1 to 15 micrometers, preferably from 2 to 10 micrometers by any known coating apparatus such as, for example, a bar coater, a gravure coater or the like, and dried.

PREFERRED EMBODIMENT OF THE INVENTION

The present invention is described in more detail by way of examples and comparative examples, which should not be construed as limiting the invention.

EXAMPLE 1

A paper stock comprised of 30 parts of bleached NKP and 70 parts of bleached LKP to which 0.4 parts of a rosin size, 10 parts of talc and 2.3 parts of aluminium sulfate were added was prepared and subjected to paper making by means of a Fourdrinier paper machine at a rate of 600 m/minute in such a way that a dry weight was 101 g/m$^2$, followed by coating a oxidized starch solution having a concentration of 6% by the use of a size press in an amount of 50 ml/m$^2$, drying and winding-up. The resultant base paper was subjected to super-calendering under the following conditions.

Super calendering conditions:
linear pressure 200 kg/cm
surface temperature of chrominum-plated metal roll : 25° C.
running speed of paper 250 m/minute
number of nips for running paper: 4

After the super calendering, the base paper had a Kopp water absorption (5 second value) of 10.4 g/m$^2$ and a smoothness of 13% as determined by the specular reflection smoothness tester at a pressure of 20 kg/cm$^2$.

An intermediate layer was formed on the surface of the base paper in the following manner.

A coating to form the intermediate layer was prepared by adding 10 parts of precipitated calcium carbonate (commercial name: Brilliant S-15, made by Shiraishi Calcium Kaisha, Ltd.) to 90 parts of modified styrene-butadiene-methyl methacrylate copolymer latex (commercial name: JSR-0530, made by Japan Synthetic Rubber Co., Ltd.) while agitating in a mixer, to which water was added in order to make a concentration of 50%. Subsequently, 3 parts (solid content) of oxidized starch and 1 part of calcium stearate (commercial name: Nopcote C-104, made by SAN NOPCO Co., Ltd.) were added to the dispersion, to which water was added so as to make a solid content of 47%. The resultant coating was applied onto the base paper surface by means of a wire bar in a dry thickness of 25 micrometers and dried to form an intermediate layer.

A coating for an image-receiving layer was prepared as follows.

100 parts of a polyester resin (commercial name: Vylon 200, made by Toyobo Co., Ltd.), 0.5 parts of an amino-modified silicon (commercial name: KF-393, made by The Shinetsu Chemical Co., Ltd.), and 0.5 parts of an epoxy-modified silicon (commercial name: X-22-343, made by Shinetsu Chem. Ind. Co., Ltd.) were added to methyl ethyl ketone/toluene (ratio by weight of 1:1) while agitating with a mixer to obtain a coating for the image-receiving layer having a solid content of 15%. The coating was applied onto the surface of the intermediate layer in a dry thickness of 7 micrometers by means of a wire bar and dried, followed by pressing under the following supercalendering conditions to obtain an image-receiving sheet for thermal transfer printing.

Super calendering conditions:
linear pressure 90 kg/cm
surface temperature of a chrominum-plated metal roll: 70° C.
running paper speed 5 m/minute
number of nips for running paper: 2

On the other hand, a thermal transfer sheet was made in the following manner.

40 parts of a sublimable disperse dye (commercial name: Kayaset Blue 714, made by Nippon Kayaku Co., Ltd.) and 60 parts by weight of polyvinyl butyral were added to methyl ethyl ketone/toluene (ratio by weight of 1:1) while agitating in a mixer to obtain an ink composition for formation of a thermal transfer layer having a solid content of 10%. The composition was applied onto a 4.5 micrometer thick PET film whose back side had been subjected to heat-resisting treatment, in a dry weight of 1 g/m$^2$ by means of a wire bar and dried to obtain a thermal transfer sheet.

The thus obtained thermal transfer sheet was superposed on the image-receiving sheet for thermal transfer printing, followed by printing under conditions of an output power of 1 W/dot, a pulse width of 0.3 to 4.5 msec., and a dot density of 3 dots/mm for evaluation. The results are shown in Table 1.

EXAMPLE 2

A base paper sheet obtained in the same manner as in Example 1 was applied with a coating prepared in the following manner.

60 parts of ground calcium carbonate (commercial name: Sofuton 1800, made by Bihoku Funka Kogyo Kabushiki Kaisha), precipitated calcium carbonate (commercial name: Brillian S-15, made by Shiraishi Calcium Kaisha, Ltd.), and 0.2 parts of sodium polyacrylate were dispersed in water by means of Cowels Dissolver (made by Morehomse Industries, Inc.) to obtain a pigment slurry having a solid content of 55%. To the slurry were added 3 parts (as solid) of oxidized starch and 12 parts (as solid) of a modified styrene-butadiene copolymer latex (commercial name: JSR-0696, made by Japan Synthetic Rubber Co., Ltd.), followed by further addition of water to make a coating having a solid content of 50%.

The thus obtained coating was applied onto the base paper obtained in the same manner as in Example 1 in a dry thickness of 25 micrometers and dried. The coated paper was pressed under the following supercalendering conditions.

Super calendering conditions:
linear pressure 60 kg/cm
surface temperature of a chrominum-plated metal roll: 25° C.
running paper speed: 5 m/minute
number of nips for running paper: 2

The coated paper obtained after the super calendering treatment had a Kopp water absorption (5 second value) of 12.3 g/m$^2$ and a smoothness (under a pressure of 20 kg/cm$^2$) of 16% when determined by a specular reflection smoothness tester.

Subsequently, the procedures of Example 1 were repeated with respect to the intermediate layer formation and subsequent procedures to make an image-receiving sheet for thermal transfer printing. Thereafter, the sheet was evaluated in the same manner as in Example 1. The results are shown in Table 1.

EXAMPLE 3

0.2 parts of a rosin size, 10 parts of talc and 0.7 parts of aluminum sulfate were added to a pulp mixture of 60 parts of bleached NKP and 40 parts of bleached LKP to obtain a paper stock, followed by subjecting to paper making with a paper making machine and drying to obtain a base paper having a basis weight of 101 g/m$^2$. The base paper was applied with a 2% oxidized starch solution in an amount of 10 ml/m$^2$ by the use of a size press, dried and supercalendered under the following conditions.

Super calendering conditions:
linear pressure: 100 kg/cm
surface temperature of a chrominum-plated metal roll: 70° C.
running paper speed: 5 m/minute
number of nips for running paper: 4

The base paper had a Kopp water absorption (5 second value) of 41.2 ml/m$^2$ and a smoothness (under a pressure of 20 kg/cm$^2$) of 23% when determined by the specular reflection smoothness tester.

Subsequently, the procedures of Example 1 were repeated with respect to the intermediate layer formation and subsequent procedures to make a sheet to be thermally transferred. The sheet was evaluated in the same manner as in Example 1. The results are shown in Table 1.

EXAMPLE 4

A base paper obtained in the same manner as in Example 1 was applied with a coating prepared in the following manner.

50 parts of ground calcium carbonate (commercial name: BF-100, Bihoku Funka Kogyo Kabushiki Kaisha), 50 parts of ground calcium carbonate (commercial name: Sofuton 1800, made by Bihoku Funka Kogyo Kabushiki Kaisha), and 0.2 parts of sodium polyacrylate were dispersed in water by means of a Cohless dispersing machine to make a pigment slurry having a solid content of 55%. 2 parts (solid content) of oxidized starch and 10 parts (solid content) of a modified styrenebutadiene copolymer latex (commercial name: JSR-0696, made by Japan Synthetic Rubber Co., Ltd.) were added to the slurry, followed by further addition of water to make a coating having a solid content of 50%. The thus obtained coating was applied onto the base paper obtained in the same manner as in Example 1 in a dry thickness of 25 micrometers and dried. The coated paper was not super calendered.

The coated paper had a Kopp water absorption (5 second value) of 11.5 g/m$^2$ and a smoothness (under a pressure of 20 kg/cm$^2$) of 5% when determined by a specular reflection smoothness tester.

Thereafter, the procedures of Example 1 were repeated with respect to the subsequent procedures including the formation of the intermediate layer to obtain an image-receiving sheet for thermal transfer printing, followed by evaluation in the same manner as in Example 1. The results ar shown in Table 1.

EXAMPLE 5

A base paper obtained in the same manner as in Example 1 was applied with a coating prepared in the following manner.

60 parts of kalolin (commercial name: Ultra White 90, made by EMC) and 40 parts of precipitated calcium carbonate (commercial name: Brilliant S-15, made by Shiraishi Calcium Kaisha, Ltd.) were dispersed in water by means of Cowels Dissolver dispersing machine to obtain a pigment slurry having a solid content of 58%. To the slurry were added 10 parts (solid content) of casein, 16 parts (as solid) of a modified styrene-butadiene copolymer latex (commercial name: JSR-0696, made by Japan Synthetic Rubber Co., Ltd.) and 3% (as solid) of zinc sulfate heptahydrate, followed by further addition of water to make a coating having a solid content of 50%. The thus obtained coating was applied onto the base paper obtained in the same manner as in Example 1 in a dry thickness of 25 micrometers and dried. The coated paper was rewet-casted under the following conditions.

Rewet-casting conditions:
drum temperature 105° C.
running pressure 100 kg/cm
rewetting solution aqueous solution of 0.5% polyethylene emulsion The coated paper obtained after the re-wet casting had a Kopp water absorption (5 second value) of 15.1 g/m$^2$ and a smoothness (under a pressure of 20 kg/cm$^2$) of 85% when determined by a specular reflection smoothness tester.

The procedures of Example 1 were subsequently repeated with respect to the intermediate layer formation and subsequent procedures to make an image-receiving sheet for thermal transfer printing. Thereafter, the sheet was evaluated in the same manner as in Example 1. The results are shown in Table 1.

EXAMPLE 6

An intermediate layer was formed in the following manner on the surface of a substrate sheet obtained in the same manner as in Example 2.

5 parts of fine particles A of a polypropylene resin (test sample from SAN NOPCO Co., Ltd.) and 95 parts of a modified styrene-butadiene-methyl methacrylate copolymer latex (commercial name: JSR-0530, made by Japan Synthetic Rubber Co., Ltd.) were agitated with a mixer, to which water was added so as to make a 45% slurry. Further, 10 parts (as solid) of oxidized starch and 1 part of calcium stearate (commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 7

An intermediate layer was formed in the following manner on the surface of a substrate sheet obtained in the same manner as in Example 2.

15 parts of fine particles A of a polypropylene resin (test sample from SAN NOPCO Co., Ltd.) and 85 parts of a modified styrene-butadiene-methyl methacrylate copolymer Latex (commercial name: JCR-0530, made by Japan Synthetic Rubber Co., Ltd.) were agitated with a mixer, to which water added so as to make a 45% slurry. Further, 10 parts (as solid of oxidized starch and 1 part of calcium stearate (Commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation an subsequent procedures to obtain an image-receiving sheet for thermal transfer printing, followed by evaluation in the same manner as in Example 1. The results are shown in Table 1.

EXAMPLE 8

An intermediate layer was formed in the following manner on the surface of a substrate sheet obtained in the same manner as in Example 2.

30 parts of fine particles A of a polypropylene resin (test sample from SAN NOPCO Co., Ltd.) and 70 parts of a modified styrene-butadiene-methyl methacrylate copolymer latex (commercial name: JSR-0530, made by Japan Synthetic Rubber Co., Ltd.) were agitated with a mixer, to which water was added so as to make a 45% slurry. Further, 10 parts (as solid) of oxidized starch and 1 part of calcium stearate commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 9

An intermediate layer was formed in the following manner on the surface of a substrate sheet obtained in the same manner as in Example 2.

70 parts of fine particles A of a polypropylene resin (test sample from SAN NOPCO Co., Ltd.) and 30 parts of a modified styrene-butadiene copolymer latex (commercial name: JSR-0696, made by Japan Synthetic Rubber Co., Ltd.) were agitated with a mixer, to which water was added so as to make a 43% slurry. Further, 10 parts (as solid) of oxidized starch and 1 part of calcium stearate (commercial name: Nopcote C-104, made by SAN NOPCO Co., Ltd.) were added, followed by addition of water to make 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 10

An intermediate layer was formed in the following manner on the surface of a substrate sheet obtained in the same manner as in Example 2.

130 parts of fine particles B of a polyethylene resin (test sample from SAN NOPCO Co., Ltd.) and 70 parts of a modified styrene-butadiene-methyl methacrylate copolymer latex (commercial name: JSR-0530, made by Japan Synthetic Rubber Co., Ltd.) were agitated with a mixer, to which water was added so as to make a 45% slurry. Further, 10 parts (as solid) of oxidized starch and 1 part of calcium stearate (commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 11

An intermediate layer was formed in the following manner on the surface of a substrate sheet obtained in the same manner as in Example 2.

30 parts of fine particles C of an ethylene-propylene copolymer resin (test sample from SAN NOPCO Co., Ltd.) and 70 parts of a modified styrene-butadiene-methyl methacrylate copolymer latex (commercial name: JSR-0530, made by Japan Synthetic Rubber Co., Ltd.) were agitated with a mixer, to which water was added so as to make a 45% slurry. Further, 10 parts (as solid) of oxidized starch and 1 part of calcium stearate (commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 12

An intermediate layer was formed in the following manner on the surface of a substrate sheet obtained in the same manner as in Example 2.

30 parts of fine particles D of a polyethylene resin (test sample from Toho Chem. Co., Ltd.) and 70 parts of a modified styrene-butadiene-methyl methacrylate copolymer latex (commercial name: JSR-0530, made by Japan Synthetic Rubber Co., Ltd.) were agitated with a mixer, to which water was added so as to make a 45% slurry. Further 10 parts (as solid) of oxidized starch and 1 part of calcium stearate (commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 13

An intermediate layer was formed in the following manner on the surface of a substrate sheet obtained in the same manner as in Example 2.

30 parts of fine particles of a polyethylene resin (commercial name: Chemipearl W-300, made by Mitsui Petrochemical Industries Co., Ltd.) and 70 parts of a modified styrene-butadiene-methyl methacrylate copolymer latex (commercial name: JSR-0530, made by Japan Synthetic Rubber Co., Ltd.) were agitated with a mixer, to which water was added so as to make a 45% slurry. Further, 10 parts (as solid) of oxidized starch and 1 part of calcium stearate (commercial name: Nopcote C-104, made by SAN NOPCO Co., Ltd.) were added, followed by addition of water to make a 40% coating.

The resultant coating was applied onto the substrate sheet obtained above in a dry thickness of 25 micrometers by means of a wire bar and dried to form an intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 14

An intermediate layer was formed in the following manner on the surface of a substrate sheet obtained in the same manner as in Example 2.

70 parts of thermally expandable hollow particles (commercial name: Matsumoto Microsphere F-30, made by Matsumoto Yushi-Seiyaku Co., Ltd.) whose shell walls have a softening temperature of from 80° to 85° C. and 30 parts of a modified styrene-butadiene latex (commercial name: JSR-0696, made by Japan Synthetic Rubber Co., Ltd.) were agitated with a mixer, to which water was added so as to make a 45% coating.

The resultant coating was applied onto the surface of the substrate sheet obtained above by means of a wire bar in a dry weight of 3.5 g/m$^2$ and dried at 120° C. for 1 minute. After the drying, the thermally expandable hollow particles were individually expanded to 30 to 70 times larger.

A coating of polyvinyl alcohol (commercial name: PVA-110, made by Kuraray Co., Ltd.) was formed by the use of a wire bar in a dry weight of 3.5 g/m$^2$ as an upper layer of an intermediate layer and dried to form the intermediate layer.

Subsequently, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

EXAMPLE 15

An intermediate layer was formed in the following manner on the surface of a substrate sheet obtained in the same manner as in Example 1.

70 parts of thermally expandable hollow particles (commercial name: Matsumoto Microsphere F-30, made by Matsumoto Yushi-Seiyaku Co., Ltd.) and 30 parts of polyvinyl alcohol (commercial name: PVA-110, made by Kuraray Co., Ltd.) were agitated with a mixer, followed by addition of water to make a 20% coating.

The results coating was applied onto the surface of the substrate sheet obtained above in a dry weight of 3.5 g/m$^2$ by means of a wire bar, and dried at 120° C. for 1 minute.

Thereafter, the procedures of Example 1 was repeated with respect to the image-receiving layer formation an subsequent procedures to make an image-receiving sheet for thermal transfer printing. The sheet was evaluated in the same manner as in Example 1. The results are shown in Table 1.

EXAMPLE 16

The procedures of Example 15 were repeated to thereby make an image-receiving sheet for thermal transfer printing, followed by super calendering under the following conditions.

Super calendering conditions:

linear pressure 90 kg/cm surface temperature of a chromium-plated metal roll : 70° C.

running paper speed 5 m/minute number of nips for running paper: 2

By the treatment, the thickness of the image-receiving sheet was reduced from 165 micrometers to 110 micrometers. Subsequently, the sheet was evaluated in the same manner as in Example 1 with the results shown in Table 1.

EXAMPLE 17

An intermediate layer was formed in the following manner on the surface of a substrate sheet obtained in the same manner as in Example 1.

80 parts of hollow particles of a polyethyrene resin (commercial name: Ropaque OP-84J, made by Rohm & Haas Japan Kabushiki Kaisha) and 20 parts of a modified styrenebutadiene copolymer latex (commercial name: JSR-0696, made by Japan Synthetic Rubber Co., Ltd.) were agitated with a mixer, followed by addition of water to make a 40% coating.

The resultant coating was applied onto the substrate sheet obtained above by means of a wire bar in a dry thickness of 20 micrometers and dried.

As an upper layer of the intermediate layer, polyvinyl alcohol (commercial name: PVA-110, made by Kuraray Co., Ltd.) was applied by means of a wire bar in a dry weight of 3.5 g/m$^2$ and dried to form the intermediate layer.

Thereafter, the procedures of Example 1 were repeated with respect to the image-receiving layer formation and subsequent procedures to obtain an image-receiving sheet for thermal transfer printing, followed by evaluation in the same manner as in Example 1. The results are shown in Table 1.

COMPARATIVE EXAMPLE 1

An intermediate layer was formed in the following manner on the surface of a substrate sheet obtained in the same manner as in Example 2.

While agitating 90 parts of a modified styrenebutadiene copolymer latex (commercial name: JSR-0696, made by Japan Synthetic Rubber Co., Ltd.) with a mixer, 10 parts of precipitated calcium carbonate (commercial name: Brilliant S-15, made by Shiraishi Calcium Kaisha Ltd.) were added, followed by addition of water to make a 45% slurry. Moreover, 3 parts (as solid) of oxidized starch and 1 part of calcium stearate (commercial name: Nopcote C-104, made by SAN NOPCO Co., Ltd.) were added, followed by further addition of water so that a solid content was 40%.

The resulting coating was applied onto the surface of the substrate sheet obtained above by means of a wire bar in a dry thickness of 25 micrometers, and dried.

Thereafter, the procedures of Example 1 were repeated with respect to the image-receiving layer formation and subsequent procedure to obtain an image-receiving sheet for thermal transfer printing. This sheet was found to have fine wrinkles on the surface thereof, and the solvent for the image-receiving layer infiltrated spottedly into the substrate, causing strinking-through. It was clear that the intermediate layer was swollen or dissolved with the organic solvent for the image-receiving layer.

The sheet was evaluated in the same manner as in Example 1. The results are shown in Table 1.

COMPARATIVE EXAMPLE 2

An intermediate layer was formed in the same manner as in Comparative Example 1 on the surface of a substrate sheet obtained in the same manner as in Example 5.

Thereafter, the procedures of Example 1 were repeated with respect to the image-receiving layer formation and subsequent procedures to make an image-receiving sheet for thermal transfer printing. As a result, it was found that the sheet has fine wrinkles on the surface, revealing that the intermediate layer was swollen or dissolved with the organic solvent for the image-receiving layer.

The sheet was evaluated in the same manner as in Example 1. The results are shown in Table 1.

COMPARATIVE EXAMPLE 3

The procedures of Example 14 were repeated, except that the upper layer of the intermediate layer was not formed and after formation of the lower layer, to thereby form a image-receiving layer directly. As a result, it was found that the solvent for the image-receiving layer infiltrated into the substrate, causing striking-through. Then, it was also found that the thickness of the sheet prior to and after formation of the image-receiving layer was reduced from 160 micrometers to 135 micrometers. This revealed that the intermediate layer was dissolved with the organic solvent for the image-receiving layer.

The sheet was evaluated in the same manner as in Example 1. The results are shown in Table 1.

COMPARATIVE EXAMPLE 4

The procedures of Example 17 were repeated, except that the upper layer of the intermediate layer was not formed and after formation of the lower layer, to thereby form an image-receiving layer directly. As a result, it was found that the resultant sheet had fine wrinkles on the surface, revealing that the intermediate layer was swollen and dissolved with the organic solvent for the image-receiving layer.

The sheet was evaluated in the same manner as in Example 1. The results are shown in Table 1.

Now, in Table 1, the evaluation methods for the respective tests are described below.

1. Resistance to organic solvent

The resistance was evaluated by visual observation and measurement of a sheet thickness.

A . . . no problem

E . . . no practical utility with a great number of defects

2. Anti-blocking properties

The intermediate layer and a black drawing paper were superposed and passed twice through a supercalender at a linear pressure of 50 kg/cm, after which the layer and the paper were separated from each other to observe the respective surfaces.

A . . . little black fibers of the drawing paper transferred to the intermediate layer, and no practical problem E . . . the intermediate layer and the drawing paper bonded together 3. Optical density The optical density of cyan color transferred onto the image-receiving layer was evaluated by the use of a reflection densitometer (Macbeth RD914).

A . . . maximum value not less than 1.4

B . . . maximum value of from 1.2 to 1.4

C . . . maximum value of less than 1.2

4. Image quality

Evaluated through visual observation of missing transfer portion(s)

AA . . . very excellent image quality with no missing transfer portion(s)

A . . . little missing transfer portions observed with excellent image quality

B . . . slight missing transfer portions observed with good image quality

C . . . missing transfer portions observed but with no practical problem on image quality D . . . many missing transfer portions observed with poor image quality E . . . a great number of missing transfer portions observed with practically unacceptable image quality

TABLE 1

| | Example 1 | Example 2 | Example 3 | Example 4 | Example 5 |
|---|---|---|---|---|---|
| Base Sheet | wood free paper | coated paper | wood free paper | coated paper | cast-coated paper |
| smoothness (%) | 13 | 16 | 23 | 5 | 85 |
| water absorption degree (g/m$^2$) | 10.4 | 12.3 | 41.2 | 11.5 | 15.1 |
| Main consituent of the intermediate layer | JSR-0530(1) (Produced by Japan Synthetic Rubber Co., Ltd.) | same as in Example 1 | same as in Example 1 | same as in Example 1 | same as in Example 1 |
| Resistance to solvents | A | A | A | A | A |
| Anti-blocking property | A | A | A | A | A |
| Optical density | A | A | A | A | A |
| Image quality | B | A | C | C | A |

| | Comparative Example 1 | Comparative Example 2 | Example 6 | Example 7 |
|---|---|---|---|---|
| Base sheet | coated paper | cast-coated paper | coated paper | same as in Example 6 |
| smoothness (%) | 16 | 85 | 16 | |
| water absorption degree (g/m$^2$) | 12.3 | 15.1 | 12.3 | |
| Main consituent of the intermediate layer | JSR-0696(2) (Produced by Japan Synthetic Rubber Co., Ltd.) | same as in Comparative | (a)JSR-0530(1) added ratio:95 weight parts (b)polypropylene(3) added ratio:5 weight parts | (a)JSR-0530(1) added ratio:85 weight parts (b)polypropylene(3) added ratio:15 weight parts |
| Resistance to solvents | E | E | A | A |
| Anti-blocking property | E | E | A | A |
| Optical density | B | B | A | A |
| Image quality | E | E | B | A |

| | Example 8 | Example 9 | Example 10 |
|---|---|---|---|
| Base sheet | same as in Example 6 | same as in Example 6 | same as in Example 6 |
| smoothness (%) | | | |
| water absorption degree (g/m$^2$) | | | |
| Main consituent of the | (a)JSR-0530(1) | (a)JSR-0696(2) | (a)JSR-0530(1) |

TABLE 1-continued

| | | | |
|---|---|---|---|
| intermediate layer | added ratio:70 weight parts (b)polypropylene[3] added ratio:30 weight parts | added ratio:30 weight parts (b)polyethylene[3] added ratio:70 weight parts | added ratio:70 weight parts (b)polyethylene[4] added ratio:30 weight parts |
| Resistance to solvents | A | A | A |
| Anti-blocking property | A | A | A |
| Optical density | A | A | B |
| Image quality | A | AA | A |
| | Example 11 | Example 12 | Example 13 |
| Base sheet smoothness (%) water absorption degree (g/m$^2$) | same as in Example 6 | same as in Example 6 | same as in Example 6 |
| Main consituent of the intermediate layer | (a)JSR-0530[1] added ratio:70 weight parts (b)polyethylene-polypropylene copolymer[5] added ratio: 30 weight parts | (a)JSR-0530[1] added ratio:70 weight parts (b)polyethylene[6] added ratio:30 weight parts | (a)JSR-0530[1] added ratio:70 weight parts (b)polyethylene[7] added ratio:30 weight parts |
| Resistance to solvents | A | A | A |
| Anti-blocking property | A | A | A |
| Optical density | A | C | C |
| Image quality | A | C | A |
| | Example 14 | Example 15 | Example 16 |
| Base sheet smoothness (%) water absorption degree (g/m$^2$) | wood free paper 13 10.4 | same as in Example 1 | same as in Example 1 |
| Intermediate layer: | | | |
| (i) main consituent of the lower layer | (a)JSR-0696[2] added ratio: 30 weight parts (b)Micro sphere F-30[8] addeu ratio: 70 weight parts | (a)polyvinyl alcohol[9] added ratio: 30 weight parts (b)Micro sphere F-30[8] added ratio: 70 weight parts | same as in Example 15 |
| (ii) main consituent of the upper layer | polyvinyl alcohol[9] | none | none[*] |
| Resistance to solvents | A | A | A |
| Anti-blocking property | A | A | A |
| Optical density | A | A | A |
| Image quality | A | A | AA |
| | Example 17 | Comparative Example 3 | Comparative Example 4 |
| Base sheet smoothness (%) water absorption degree (g/m$^2$) | same as in Example 1 | same as in Example 1 | same as in Example 1 |
| Intermediate layer: | | | |
| (i) main consituent of the lower layer | (a)JSR-0696[2] added ratio: 20 weight parts (b) Ropaque OP-84J[10] added ratio: 80 weight parts | same as in Example 14 | same as in Example 17 |
| (ii) main consituent of the upper layer | polyvinyl alcohol[9] | none | none |
| Resistance to solvents | A | E | E |
| Anti-blocking property | A | A | A |
| Optical density | A | C | C |
| Image quality | B | E | E |

Note
[1]composition: styrene . . . 43 wt. %. butadiene . . . 40 wt. % gel content: 98 wt. %
[2]composition: styrene . . . 46 wt. %. butadiene . . . 38 wt. % gel content: 83 wt. %
[3]product of SAN NOPCO Ltd.: m.p. . . . 140° C., endothermic quantity(e.q.) . . . 40 cal./g, particle diameter (p.d.) . . . 2.5 μm
[4]product of SAN NOPCO Ltd.: m.p. . . . 130° C., e.q. . . . 45 cal./g, p.d. . . . 3.5 μm
[5]product of SAN NOPCO Ltd.: m.p. . . . 135° C., e.q. . . . 45 cal./g, p.d. . . . 3.0 μm
[6]product of Toho Chemical Industry Co., Ltd.: m.p. . . . 90° C., e.q. . . . 25 cal./g, p.d. . . . 0.2 μm
[7]product of Mitsui Petrochemical Industries, Ltd.: m.p. . . . 130° C., e.q. . . . 70 cal./g, p.d. . . . 4.0 μm
[8]the trademark name of the product by Matsumoto Yushi-Seiyaku Co., Ltd.
[9]product under the trademark name of PVA-110 by Kuraray Co., Ltd.
[10]the trademark name of the product by Rohm & Haas Japan Kabushiki Kaisha
[*]calendered after the formation of an image receiving layer

What we claim is:

1. An image-receiving sheet for thermal transfer printing which comprises an intermediate layer and an image-receiving layer formed on a substrate in this order, said intermediate layer being comprised primarily of a resin insoluble in an organic solvent, said image-receiving layer being comprised primarily of a resin soluble in an organic solvent, the insoluble resin being formed from a copolymer latex satisfying the following requirements (a) and (b):

(a) compositional constituents:

aliphatic conjugated diolefinic 20–70 wt. % monomer:

unsaturated acid monomer: 0.5–15 wt. % olefinic monomer other than said aliphatic conjugated diolefinic monomer:

(b) gel content: 85–100 wt. %.

2. An image-receiving sheet for thermal transfer printing according to claim 1, wherein said copolymer latex is contained in an amount not less than 60 wt. % of the total solids in said intermediate layer.

3. An image-receiving sheet for thermal transfer printing according to claim 1, wherein said substrate is a paper sheet made primarily of pulp fibers.

4. An image-receiving sheet for thermal transfer printing according to claim 3, wherein said paper sheet has a smoothness of not smaller than 6% and a water absorption of from 1 to 30 g/m$^2$ when determined by the following procedures, respectively:

Smoothness: a value measured with a specular reflection smoothness tester at a pressure of 20 kg/cm$^2$; and Water absorption: a 5 second value determined according to "a test method for water absorption of paper and paperboard (Kopp method)" prescribed in JIS P-8140.

5. An image-receiving sheet for thermal transfer printing which comprises an intermediate layer and an image-receiving layer formed on a substrate in this order, said intermediate layer being comprised primarily of a resin insoluble in an organic solvent, said image-receiving layer being comprised primarily of a resin soluble in an organic solvent, the insoluble resin being formed of fine particles of a polyolefin resin having a melting point not lower than 70° C. and a heat absorption, accompanied by softening or phase transition upon heating, of not larger than 50 cal/g.

6. An image-receiving sheet for thermal transfer printing according to claim 5, wherein the fine particles of the polyolefin resin are contained in an amount of not less than 10 wt. % of the total solids in the intermediate layer.

7. An image-receiving sheet for thermal transfer printing according to claim 6, wherein the fine particles of the polyolefin resin are contained in an amount of not less than 60 wt. % of the total solids in the intermediate layer.

8. An image-receiving sheet for thermal transfer printing according to claim 5, wherein said substrate is a paper sheet made primarily of pulp fibers.

9. An image-receiving sheet for thermal transfer printing according to claim 8, wherein said paper sheet has a smoothness of not smaller than 6% and a water absorption of from 1 to 30 g/m$^2$ when determined by the following procedures, respectively:

smoothness: a value measured with a specular reflection smoothness tester at a pressure of 20 kg/cm$^2$; and water absorption: a 5 second value determined according to "a test method for water absorption of paper and paperboard(Kopp method)" prescribed in JI P-8140.

10. An image-receiving sheet for thermal transfer printing which comprises an intermediate layer and an image-receiving layer formed on a substrate in this order, said intermediate layer being comprised primarily of a resin insoluble in an organic solvent, said image-receiving layer being comprised primarily of a resin soluble in an organic solvent, the intermediate layer containing hollow particles of an insoluble resin.

11. An image-receiving sheet for thermal transfer printing according to claim 10, wherein said hollow particles are contained in an amount of not less than 50 wt. % of the total solids in the intermediate layer.

12. An image-receiving sheet for thermal transfer printing according to claim 10, wherein said substrate is a paper sheet made primarily of pulp fibers.

13. An image-receiving sheet for thermal transfer printing according to claim 12, wherein said paper sheet has a smoothness of not less than 6% and a water absorption of from 1 to 30 g/m$^2$ when determined by the following procedures:

smoothness: a value measured by a specular reflection smoothness tester at a pressure of 20 kg/cm$^2$; and water absorption: a 5 second value determined according to "a test method for water absorption of paper and paperboard (Kopp method)" prescribed in JIS P-8140.

* * * * *